US006634914B2

(12) United States Patent
Vancil

(10) Patent No.: US 6,634,914 B2
(45) Date of Patent: Oct. 21, 2003

(54) SELF-RIGHTING WHITEWATER RAFT

(76) Inventor: Darren Vancil, 284 Holley La., Grand Junction, CO (US) 81503

( * ) Notice: Subject to any disclaimer, the term of this patent is extended or adjusted under 35 U.S.C. 154(b) by 0 days.

(21) Appl. No.: 09/865,985

(22) Filed: May 25, 2001

(65) Prior Publication Data

US 2001/0046820 A1 Nov. 29, 2001

Related U.S. Application Data

(60) Provisional application No. 60/207,491, filed on May 26, 2000.

(51) Int. Cl.[7] ..... B63B 35/58
(52) U.S. Cl. ..... 441/40; 441/38
(58) Field of Search ..... 114/345, 362, 114/61.1, 61.11, 61.22, 61.24, 61.25; 441/35, 38, 40

(56) References Cited

U.S. PATENT DOCUMENTS 3,785,317 A * 1/1974 Currey ..... 114/61
4,723,502 A * 2/1988 Sayama ..... 114/345
4,936,242 A * 6/1990 Stelniceanu ..... 114/352
4,998,900 A * 3/1991 Wright ..... 441/38
5,013,270 A * 5/1991 Walls ..... 441/45
5,921,831 A * 7/1999 Schulze ..... 441/38

* cited by examiner

*Primary Examiner*—Ed Swinehart
(74) *Attorney, Agent, or Firm*—Christie, Parker & Hale, LLP

(57) ABSTRACT

An inflatable raft has an inflatable hull of catamaran type. The hull has parallel spaced fore-and-aft pontoons centrally of its length between elevated transverse bridges at the ends of the hull. The pontoons and bridges are connected by inclined connecting sections. Along a vertical longitudinal centerplane of the hull there is an inflatable righting structure. The righting structure is of inverted V configuration having legs connected at an arm peak above the hull. Lower ends of the legs are connected to the bridges so that the arm extends between the bridges. Inflatable righting sponsons can extend laterally from the arm at its peak area.

36 Claims, 5 Drawing Sheets

SELF-RIGHTING WHITEWATER RAFT

CROSS-REFERENCE TO PRIOR APPLICATION

This application claims the priority of U.S. provisional patent application No. 60/207,491 filed May 26, 2000.

FIELD OF THE INVENTION

This invention pertains to watercraft of raft-like nature. More particularly, it pertains to an inflatable raft which has inherent self-righting properties; its uses include whitewater rafting.

BACKGROUND OF THE INVENTION

Whitewater rafting is a sport and also a recreational activity. Many people participate in whitewater rafting as customers of businesses which own rafts on which, through guides, adventuresome customers pay to ride as the raft floats down a watercourse through rapids of varying degrees of hazard. In those instances where whitewater rafting is conducted as a business, as well as in the sporting context, it is important that the raft be as inherently safe as possible, while also providing to passengers a sense of exposure to hazard and danger.

Whitewater rafts commonly are inflatable watercraft. A widely used form of raft has a generally ringlike inflatable hull with generally parallel side portions between an arcuate stern and a generally pointed and upwardly sloped prow or forward end. In that form of raft, there is a fabric floor which spans the central opening in the hull and which is connected at its edges to the bottom extent of the annular hull substantially around the circumference of the hull. The passengers typically sit on or astride the side portions of the hull and paddle as directed by the guide to steer and turn the raft. While popular, rafts of the kind just described are subject to being overturned and to being caught in hydraulic reversals (also known as keepers, maytags or drowning machines) which keep the raft from moving downstream out of a hazardous situation. While not common, it is not unknown for participants in whitewater rafting to be seriously injured or even killed as a consequence of being thrown or dislodged from a raft.

A need exists for improved rafts which are inherently safer for passengers, but which do not so protect passengers that the desired sense of adventure and thrill is unduly dulled.

SUMMARY OF THE INVENTION

This invention beneficially addresses the need identified above. The invention provides a novel inflatable raft structure which has an inherent self-righting characteristic. Tests conducted with the new raft structure establish that it is very resistant to overturning and, if overturned, substantially self-rights itself automatically and quickly. Also, the hull is resistant to the effects of hydraulic reversals often encountered in rapids.

Generally speaking, a first form of raft of this invention comprises an elongate annular inflatable hull having a front end and a rear end and which is symmetrical about a hull vertical longitudinal center plane. The raft includes an inflatable righting structure extending centrally of the hull between the hull front and rear ends and disposed substantially above the hull at substantially the mid-length of the hull.

Also generally speaking, a second form of raft of this invention has an inflatable hull of substantially catamaran configuration. The hull is comprised of a pair of pontoons parallel to and on opposite sides of a hull vertical longitudinal center plane. Lower extents of the pontoons lie in a hull base plane. The hull also is comprised by forward and rear transverse bridges disposed substantially normal to the center plane with lower extents elevated above the base plane a distance greater than the design draft of the raft. The hull is further comprised by connecting sections inclined to the base plane and connecting forward and rear ends of the pontoons to the respective bridges.

DESCRIPTION OF THE DRAWINGS

The new inflatable raft structure is described with reference to the accompanying drawings of presently preferred and other forms of the raft. The drawings are composed of Figures as follows.

DESCRIPTIONS OF EXEMPLARY RAFTS

Figure 1:
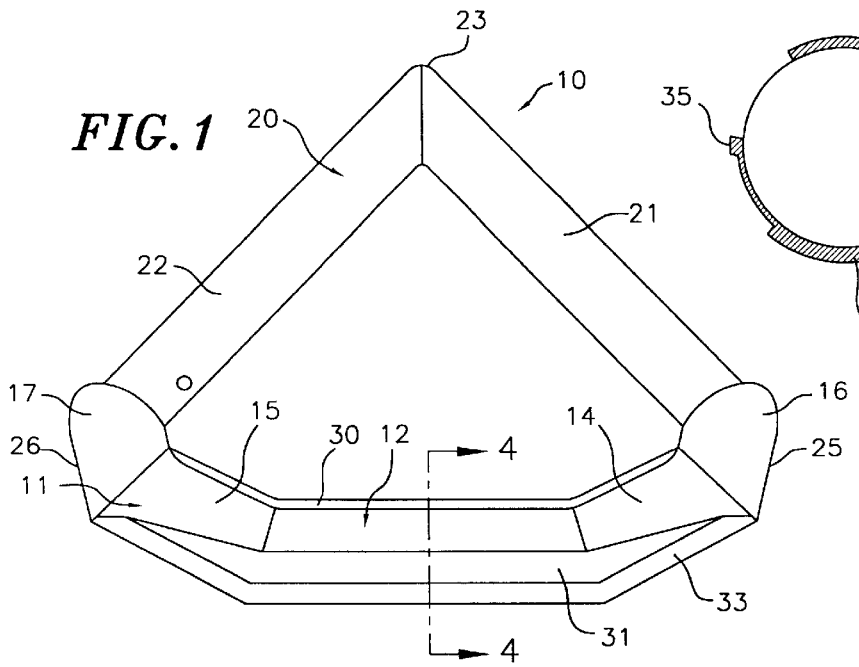
FIG. 1 is a side elevation view of a first form of the raft.
Figure 2:
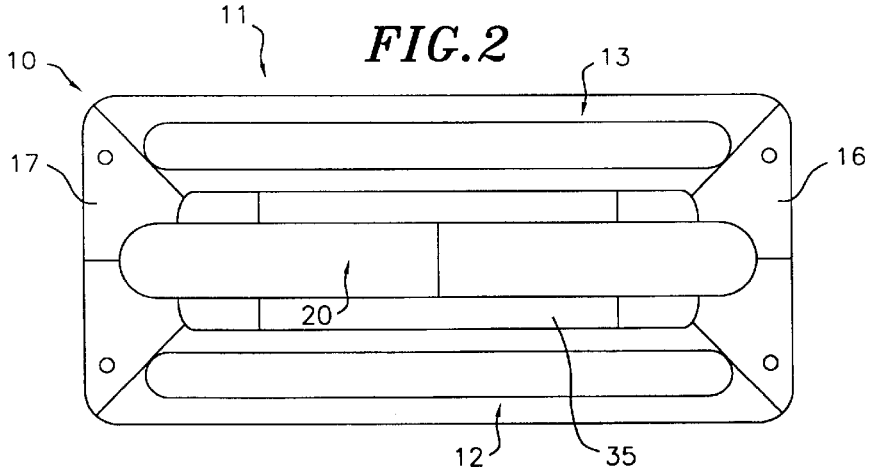
FIG. 2 is a top plan view of the raft.

As shown in the accompanying drawings, notably FIGS. 1–4, raft 10 has an inflatable hull 11 of rectangular platform shape (FIG. 2). The hull is of catamaran type and includes two substantially parallel elongate side portions or pontoons 12 and 13 which are connected at their opposite ends by upwardly inclined front 14 and rear 15 connecting sections to transverse front 16 and rear 17 bridges which, like the pontoons and their connecting sections, are inflatable to a substantially rigid state. The front and rear bridges 16, 17 are connected along the longitudinal centerline of the hull by an upstanding righting structure in the form of a righting arm 20 which is inflatable to a substantially rigid state. The righting arm, when seen in side elevation (FIG. 1), is of inverted V shape and lies in the longitudinal vertical center plane of the hull. The righting arm is composed of straight front 21 and rear 22 leg sections which intersect at substantially a right angle at an inverted V peak 23 of the arm. The righting arm peak is located substantially above the midlength of the raft hull.

A presently preferred raft according to FIGS. 1–4 has an overall length of 13 feet and a maximum beam of 6 feet (72 inches). Each side pontoon has a 7 foot long horizontal central section centered between the ends of the hull. The pontoon connecting sections 14 and 15 are inclined at about 42° from the base plane of the hull. The bridges 16,17 define the highest portion of the hull, apart from the righting arm 20, at 44 inches above the base plane. The forward 25 and rear 26 end faces of the raft are defined by the transverse bridges, and those faces can be vertical or sloped modestly, say 10°, downwardly from their upper ends as shown in FIG. 1. The pontoons, the connecting sections and also the bridges between their connections to the junctions with the connecting sections, preferably are of circular cross-section and, in the 13 foot raft, have diameters of 20.5 inches. The righting arm sections 21, 22 in that raft are of 18 inch diameter and preferably are of circular cross-sectional shape. The peak 23 of the righting arm is 113 inches above the base plane. The hull has internal baffles across the bridges at the centerline of the hull and across the pontoons at the midlength of each of the pontoons. Thus, the hull has four inflatable sections, one at each quarter (corner) of the hull. The interior of the righting arm is a fifth inflatable chamber in the structure of the raft.

The dimensions of the rafts given above and below are scalable to rafts of different length.

Figure 4:
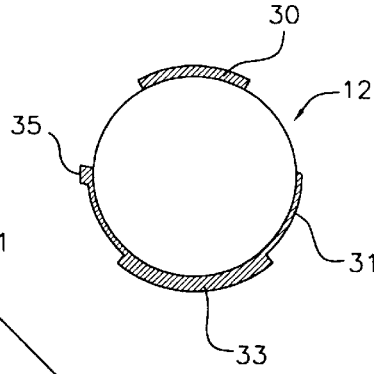
FIG. 4 is a transverse cross-sectional elevation of one of the side pontoons of the hull at line 4—4 in FIG. 1.
Figure 5:
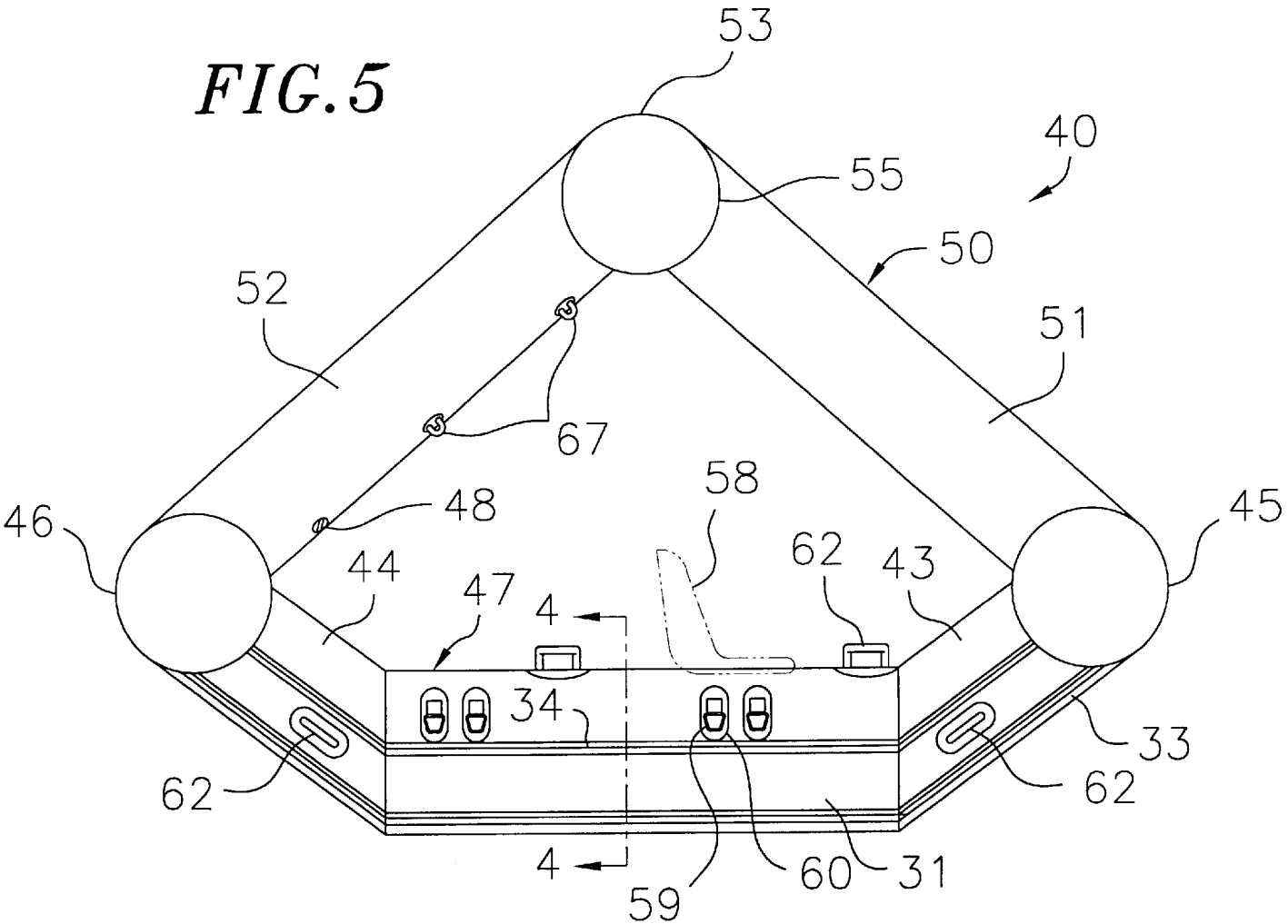
FIG. 5 is a right side elevation view of a second form of the raft.
Figure 6:
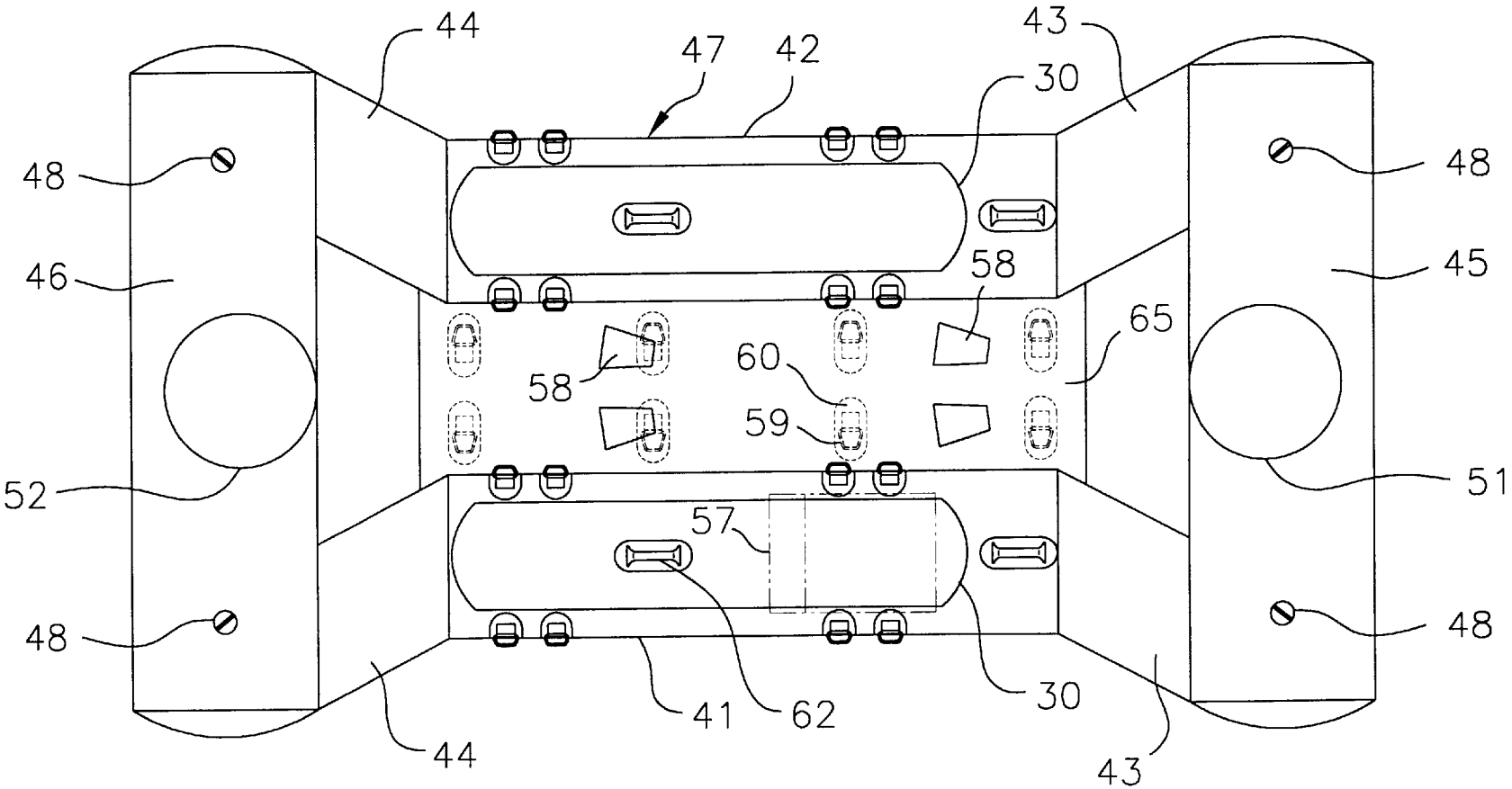
FIG. 6 is a top plan view of the raft shown in FIG. 5.
Figure 7:
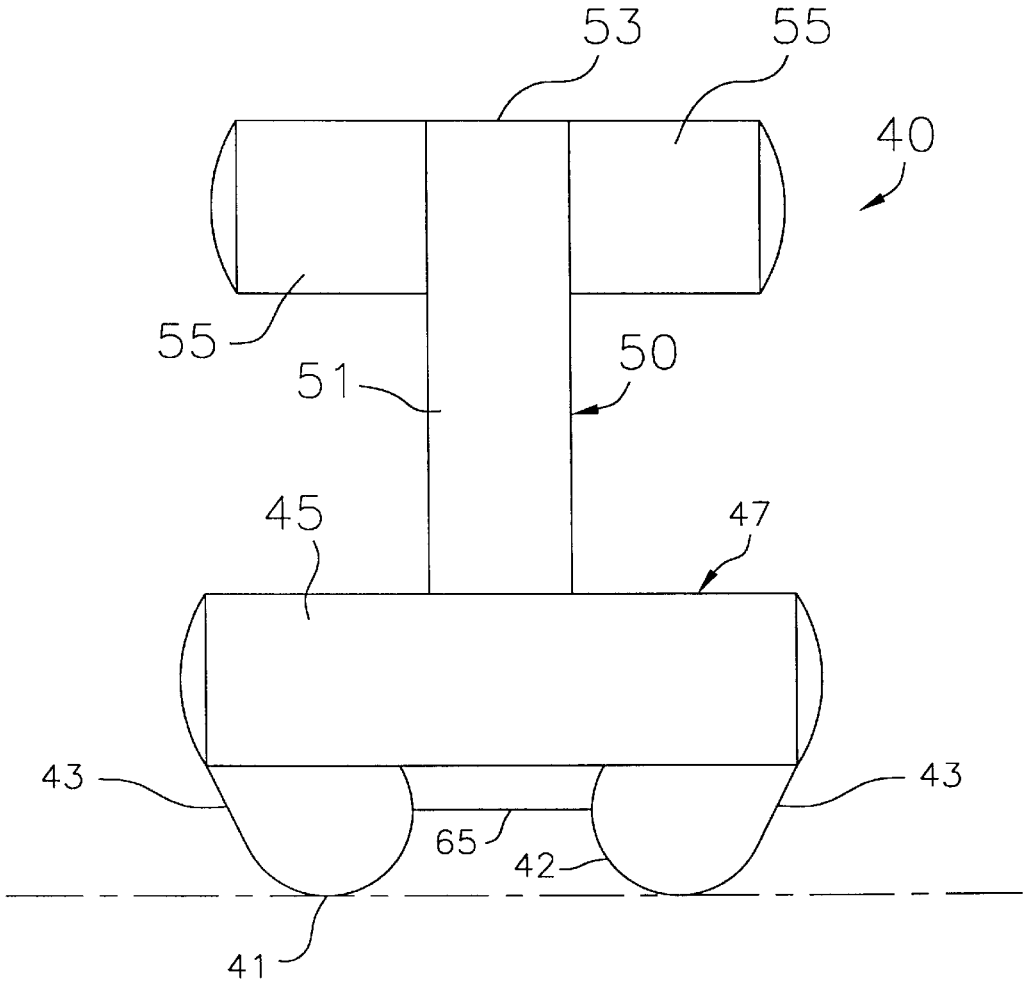
FIG. 7 is a front elevation view of the raft shown in FIGS. 5 and 6.

Another and currently more preferred form of raft 40 according to this invention is shown in FIGS. 5–7. That raft has spaced parallel central fore-and-aft, pontoons 41 and 42 which preferably are circularly cylindrical (see FIG. 4) and which connect at their ends to upwardly and outwardly inclined forward 43 and rear 44 connecting sections which, in turn, have junctions with the outboard end portions of forward 45 and rear 46 raft bridge structures. Components 41–46 of raft 40 form a generally rectangular inflatable raft body or hull 47. The connecting sections and bridges preferably are circularly cylindrical in cross-sectional configuration. In one size of raft 40, pontoons 41 and 42 and connecting sections 43 and 44 can be 24 inches in diameter, and bridges 45 and 46 can be 26 inches in diameter. The pontoons can be 78 inches in length with a 20 inch spacing between them. The bridges can have an 84 inch overall length, and the elevation of the lower extents of the bridges can be 24 inches above the raft's base plane in which the lower extents of the pontoons lie. The beam width of the raft at pontoons 41 and 42 is 68 inches, while the maximum beam of the raft is defined by the bridges. The overall length of that raft is 13 feet 6 inches. In plan view (see FIG. 6), hull 41 is substantially rectangular.

The raft body 47 can have the same internal compartmentalization as the body of raft 10. An air inlet and outlet valve structure 48 is provided for each raft body compartment, preferably adjacent each end of each bridge. A suitable valve structure is a Leafield valve obtainable from Leafield Engineering Ltd., Corsham, Wiltshire SN1 9SS, England.

Raft 40 also includes an inflatable, central, fore-and-aft righting arm 50 of inverted V geometry when seen in side elevation (see FIG. 5). Arm 50 has forward 51 and rear 52 legs which preferably are straight and connect to each other to form an arm peak 53. The opposite (forward and rear) ends of the arms are securely connected to bridges 45 and 46 at locations centered on the longitudinal centerplane of the raft hull. The peak of the righting arm, in the form of raft 50 for which hull dimensions have been stated, can be 9 feet above the hull base plane, and the legs 51 and 52 of that arm can have diameters of 20 inches. The peak of arm 50 is located substantially above the midlength of the hull.

Further, as shown best in FIG. 7, the righting arm 50 of raft 40 preferably includes left and right, coaxially aligned and horizontally transversely oriented inflatable sponsons 55. The sponsons extend to the left and to the right from the peak portion of arm 50. The sponsons provide buoyant components of the raft which, in the event of an incident which would or could cause the raft to capsize, become immersed and so provide capsize-counteracting added buoyancy of the raft in a manner which prevents capsizing and enables the raft, perhaps with a shifting of the combined weight of the raft's passengers and crew, to return to an upright floating attitude. The manner of operation of righting arm 50, and of the sponsons, is more fully described below. In the size of raft 40 for which other dimensions have been stated, the diameter of the righting arm legs can be 20 inches. The diameter of the preferably circularly cylindrical sponsons can be 26 inches, and the beamwise distance between the outboard ends of the sponsons can be 78 inches, a substantial fraction of the width of hull 41.

The interior of each righting arm leg 51, 52 preferably is its own separate inflatable chamber. The interior of one of the sponsons can be in communication with one of the right arm leg chambers, and interior of the other sponsor can be in communication with the other leg chamber. An air inlet/outlet valve 48 is located in each leg of the righting arm for inflation/deflation of each leg air chamber and of the associated sponson.

Figure 3:
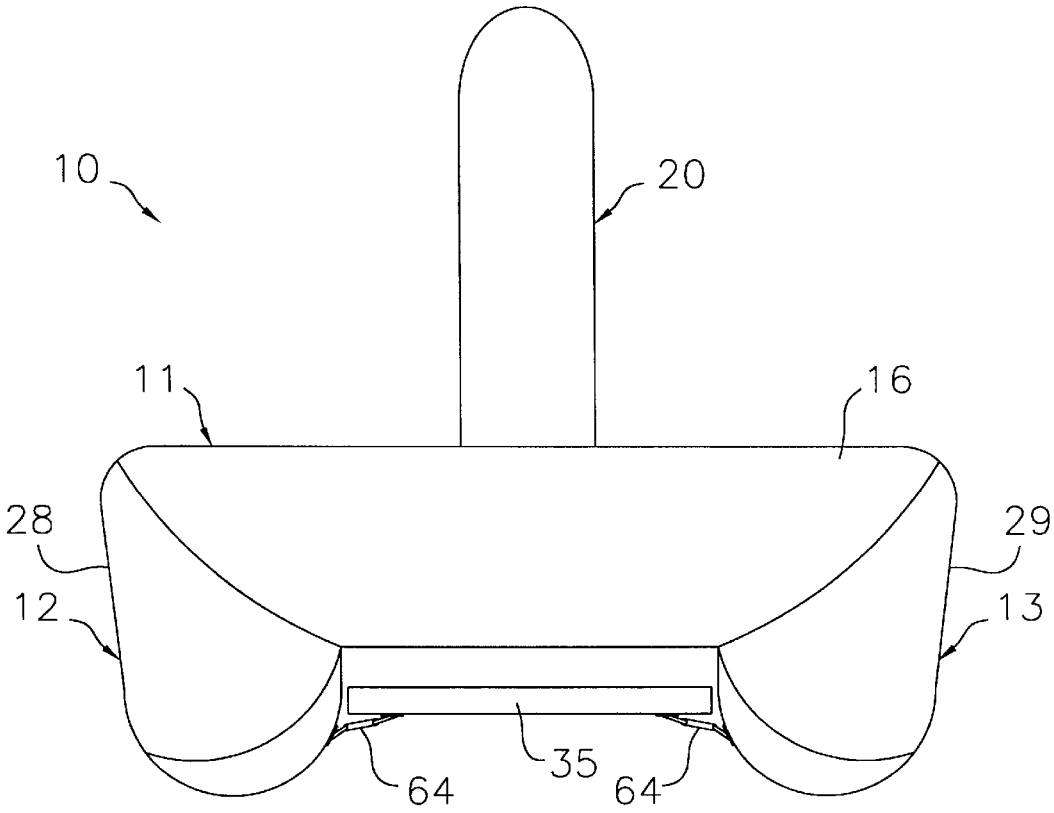
FIG. 3 is a front end elevation view of the raft.

FIGS. 3 and 7 illustrate important aspects of the geometries of hulls 10 and 40. They show that the maximum beam of the hull is at the upper outer parts of the junctions of the bridges to the pontoon connecting sections. It is there that the beam of raft 10 is greatest, say 78 inches. From those locations of hull 10, the sides of the hull are sloped substantially linearly toward each other so that the beam across hull 11 at its midlength is less than 78inches, preferably about 68 inches. The angle of deviation or slant of each hull side surface 28, 29 from a vertical reference plane is on the order of 10°. The inward slant of the hull side surfaces, as compared to vertical side surfaces, contributes to the ability of hull 11, when subjected to overturning forces, to resist turning beyond a state in which the hull side surface which moves toward immersion is horizontal. That is, hull 11, when turned to a position in which one of its side surfaces is immersed, seeks to stay in that position and to not turn further toward immersion of the peak of the righting arm. In that position, the center of mass of the raft as such is on that side of its transverse center of buoyancy which is toward the hull base plane. As a consequence, the hull is subject to a righting moment which acts in the direction of returning the hull to an upright position. It will be apparent that the geometry of hull 11 is such that as the hull moves angularly to immerse one of its side surfaces, the hull's floating center of buoyancy shifts rapidly in the direction toward which the hull is being tilted, and that shift in center of buoyancy is sufficiently great to prevent further overturning of the hull in the great majority of situations. The passengers in the raft need only stay in place and the raft returns quickly to an upright position.

In unusual instances when passing through a rapids, the hull can be subjected to more extreme overturning forces which are adequate to turn hull 11 beyond a state in which it tends to float on a side surface. In that event, the righting arm 20 of raft 10 becomes effective to prevent the hull from turning 180° into a fully inverted position. The peak of the righting arm, in such an instance, first becomes immersed. As soon as arm peak 23 becomes immersed, the raft's transverse floating center of buoyancy begins to shift rapidly toward the peak, much faster than the center of mass effectively moves in the same direction. That shift in center of buoyancy generates a moment on raft 10 which acts against the overturning forces. The greater the extent of immersion of the righting arm, the greater the counteraction to the overturning forces. The raft quickly ceases to respond further to the overturning forces, and begins to turn toward an upright position. The dynamics of whitewater rafting are such that, very often, the raft self-rights without any action needed by passengers of the raft. If the raft does not actually self-right, movement (as by leaning) of the passengers toward the hull base plane or toward the one of pontoons 13, 14 which then is raised above the water, usually is sufficient to shift the raft center of mass in the correct direction enough to cause the raft to return to an upright state.

Similar and other features and principles are present in raft 40 shown in FIGS. 5–7. In raft 50 as in raft 10, the hull sloping side surfaces are defined by the portions of the hull which interconnect the central parallel pontoons and the forward and rear bridges. The bridges of hull 47 are proportionately longer in a beamwise direction than those of hull 11, and so the bridge ends in raft 40 have a greater and earlier-acting righting effect than do those of raft 10. Further, as will be apparent from an inspection of FIG. 7, the lateral righting sponsons 55 carried at the peak of righting arm 50 will experience immersion to a greater extent and at an earlier time than the peak of righting arm 20 in comparable circumstances tending to overturn the rafts. Thus, the center of buoyancy of raft 40 shifts more meaningfully and earlier toward the righting arm peak, and so raft 40 cannot heel toward capsize as far as raft 10 can heel. Raft 40 has a self-righting characteristic which is enhanced over the same characteristic of raft 10.

As shown in FIG. 4, each pontoon 12, 13, 41, 42 has protective materials applied to it along its length. A wear strip 30, preferably 10 inches wide, is applied to the pontoon's airtight fabric along the top of the pontoon between the raft's bridges to protect the pontoon material from abrasion by passengers and by their seats. A similar wear strip 31 is applied end-to-end of each pontoon over the bottom half of its circumference to provide protection to the pontoon from abrasion by rocks and other things it may encounter in a rapids. A zone about 12 inches wide, centered on the bottom of each pontoon, extends along the length of each pontoon and is covered by a thick layer 33 of PVC (polyvinyl chloride) gum as further abrasion resistant protection for the hull in the areas most likely to be abraded. The seam area at which edges of the PVC coated polyester sheet material, used to construct the raft, are joined on the sides of each pontoon at about the middle of the height of the pontoon, preferably are covered by the adjacent margin of wear strip 31. The corresponding margin of wear strip 31 along the outboard sides of the raft hulls are substantially thickened, by use of plural layers of wear strip material, to form longitudinal fender-like wear strakes 34 along the outer extents of the hulls.

As shown in phantom lines in FIG. 5, a raft according to this invention preferably includes a seat 57 for each person in the raft. A stirrup 58 is provided for the foot on the inboard leg of each passenger who typically rides the raft with his/her outboard leg folded over the top of the adjacent side pontoon while facing generally forward in the raft.

In a 13 foot long raft, provisions are made for four passengers. The seats are secured to the hull via adjustable straps (not shown), preferably woven nylon straps, which are engaged in D-rings 59 which are captive in fittings 60 bonded to the exterior surface of the hull. The seats preferably have bottoms and backs and are distributed evenly both transversely and longitudinally in the hull. The bottom of each seat preferably has secured to it a pair of parallel structural tubes which extend in the fore and aft direction of the hull. The seat mounting straps are engaged with those tubes. The tubes and the seat bottoms provide three spaced areas of contact between each seat assembly and the adjacent cylindrical pontoon. It is preferred that the structural tubes of the seat assemblies are of increased diameter from seat to seat along each pontoon, so that each passenger who is located behind another passenger is seated higher than the passenger immediately in front and so can see ahead better.

It is preferred that each passenger be secured in his seat by a lap belt connected to the seat. The lap belt is of fabric construction and preferably includes Velcro fasteners as easily openable closure (clasp) devices.

While not presently preferred, but contemplated where a raft is to be used in relatively calm waters, an outboard footrest can be provided for each passenger. Each footrest preferably has a vertical leg disposed adjacent the hull, and a horizontal leg which extends from the top edge of the vertical leg in a direction away from the adjacent pontoon. Two pairs of upper and lower fittings 60, with D-rings 59, can be bonded to the pontoon surfaces above and below the footrest position. Securing straps for each footrest can pass from adjacent D-rings through slots along the bottom portion of the vertical leg and through slots in the rest in or near its top. The horizontal or tread leg of each rest preferably carries a socket-like foot cuff or stirrup (see stirrups 58) into which a passenger can insert the forward part of his foot. The footrests and stirrups increase comfort for raft passengers and provides supports to make it easier for a passenger to paddle more comfortably and effectively. A wear resistant material can be carried by the hull in the vicinity of a footrest.

As shown in FIGS. 5 and 6, lifting handles 62 can be bonded to the outer surfaces of each raft pontoon at spaced locations along the length of the pontoon. The handles can be secured to the top of each central pontoon. Also, as shown, handles can be secured to the outer side surfaces of the hull connecting sections 14, 15 and 43, 44. The lifting handles are used for carrying the raft as is needed from time to time. The handles secured to the tops of the pontoons are located in front of respective passenger stations and can be grasped by the passengers if the raft heels significantly.

A horizontal deck or floor 35 is provided in raft 10 to span between the pontoons in the central portion of the raft hull. The deck 35 can be rigid and, if so, preferably is floatable in its own right. A rigid buoyant deck can be secured between the pontoons via fittings bonded to the deck and to the opposing surfaces of the pontoons as shown at 64 in FIG. 3; see also elements 59 and 60 in FIG. 6, e.g. The fore-and-aft length of deck 35 is less than the distance between bridges 16,17 and provides large openings between the deck and the hull at the opposite ends of the raft. The front opening preferably is 24 inches by 26 inches, and the rear opening preferably is 24 inches by 20 inches, a distance which is greater than the design draft of the raft. The design draft is the even keel draft of the raft when loaded with the maximum designed-for weight of passengers and cargo. The bottom portions of the hull bridges are disposed above the deck in the most preferred forms of rafts of this invention. The deck is positioned above the hull base plane, preferably by about 12 inches. That positioning of the deck, and the presence of large openings through or around the deck, produces at least two beneficial effects. The openings afford ready drainage of water which can splash or otherwise enter into the hull. The deck is located sufficiently far above the hull base plane that it is above the even-keel floating waterline of the raft and so is not subject to suction action by a hydraulic reversal as would likely be the case if the deck were located at or below the floating waterline. The upper surface of the deck preferably carries fittings, such as D rings, by which cargo can be lashed to the deck; see FIG. 6.

FIGS. 6 and 7 show the presence of a deck or floor 65 in raft 40. The elevation of deck 65 in that raft preferably is 15 inches above the hull base plane in the version of that raft for which dimensions have been stated above; such a deck is elevated in the hull a distance greater than the design draft of the hull. Deck 65 preferably is fabricated of a heavier grade of the airtight fabric used in the construction of the balance of the raft. The side edges of deck 65 are bonded to the opposing surfaces of pontoons 41, 42 and of connecting sections 43, 44. The forward and rear edges of the deck preferably are located rearwardly and forwardly from bridges 45 and 46 of the raft. As shown and as noted above, the top surface of the deck can carry stirrups 50, preferably in the form of flexible fabric tapered pockets open at opposite ends, for the inboard feet of the raft's passengers. Also, the top surface of the deck of a raft according to this invention can have affixed to it D-rings 59 or other devices by which cargo can be secured in place in the raft.

The material from which the hull and righting arm structures of a raft of this invention is fabricated can be and preferably is a PVC coated polyester sheet material, more preferably a woven sheet material. The gauge or thickness of that sheet material can be 1100 denier. Where the raft includes a fabric deck, such as deck 65 of raft 40, the deck can be made of PVC coated 4000 denier polyester sheet material.

FIG. 5 shows that tethers 67 can be affixed to desired locations on the raft's righting arm for stowage of spare paddles, e.g.

In a raft according to this invention, the ratio of the elevation of the righting arm peak above the hull base plane to the overall length of the hull is in the range of from about 0.65 to about 0.75. The ratio of the width of the hull to its length is substantially 0.5, and more preferably is in the range of from about 0.50 to about 0.55.

The rectangular shape of the catamaran form of the hull, coupled with the high bow and stern rise to the transverse bridges, makes the raft resistant to over turning flips during whitewater rafting. A raft can enter a rapid and get stood on end by a large wave. The pointed ends of a conventional raft causes the raft to fall to the side and to spin about its end, causing the raft to flip to an inverted state. The geometry of raft of this invention, however, with its square and significantly buoyant ends, enables the raft to fall straight back down, and not to be buried by a large wave. The sloped sides of the raft prevent the raft from riding on its side.

The foregoing description, presented with reference to preferred and other forms of the raft, is not intended to be an exhaustive catalog of all of the specific forms which a raft of this invention may take, or of all of the features and structures which such a raft can have. Other forms, features and structures consistent with the description, and within the scope of the invention, may occur to persons skilled in the art.

What is claimed:

1. An inflatable raft floatable on water comprising an elongate inflatable hull having a front end and a rear end and which is symmetrical about a vertical longitudinal center plane, and an inflatable righting structure extending centrally of the hull between the hull front and rear ends and disposed substantially above the hull at substantially the midlength of the hull, righting structure being of inverted V configuration having a peak substantially above the midlength of the hull, the ratio of the width of the hull to its length being substantially 0.5.

2. A raft according to claim 1 in which the value of the ratio is in the range of from about 0.50 to about 0.55.

3. An inflatable raft floatable on water comprising an elongate inflatable hull having a front end and a rear end and which is symmetrical about a vertical longitudinal center plane, and an inflatable righting structure extending centrally of the hull between the hull front and rear ends and disposed substantially above the hull at substantially the midlength of the hull, the righting structure including, substantially at its greatest height above the hull, inflatable sponsons extending a selected distance laterally in opposite directions from the center plane to unsupported ends.

4. A raft according to claim 3 in which the distance between opposite ends of the sponsons is a substantial fraction of the width of the hull.

5. A raft according to claim 3 in which the righting structure comprises forward and rear substantially straight substantially cylindrical legs connected at the peak and extending to connections with the hull, and the sponsons are coaxially aligned and are substantially cylindrical.

6. A raft according to claim 5 in which the diameters of the sponsons is greater than the diameter of the legs.

7. An inflatable raft floatable on water comprising an elongate inflatable hull having a front end and a rear end which is symmetrical about a vertical longitudinal center plane, the hull being of catamaran configuration including a pair of pontoons disposed parallel to each other on opposite sides of the center plane and having bottom extents in a hull base plane, forward and rear bridges disposed transversely in the hull at locations substantially above the base plane, and connecting sections of the hull inclined to the base plane and connecting forward and rear ends of the pontoons to the respective bridges.

8. A raft according to claim 7 in which the elevation of the bridges above the base plane is greater than the design draft of the raft.

9. A raft according to claim 8 including a deck carried between the pontoons at an elevation above the base plane which is greater than the design draft of the raft.

10. A raft according to claim 9 in which the elevation of the bridges above the base plane is greater than the elevation of the deck above the base plane.

11. A raft according to claim 9 in which the deck has forward and rear ends spaced respectively from the forward and rear bridges.

12. A raft according to claim 7 in which the hull includes a deck carried between the pontoons at an elevation above the base plane which is greater than the design draft of the raft.

13. A raft according to claim 7 in which the outer side surfaces of the hull between the bridges slope upwardly outward relative to the center plane.

14. A raft according to claim 7 in which the transverse extent of the bridges is greater than the width of the raft at the pontoons.

15. A raft according to claim 7 in which the pontoons, and the bridges and connecting sections other than at the connections between them, are substantially circular in cross-section when inflated.

16. An inflatable raft floatable on water having an inflatable hull of substantially catamaran configuration which is substantially rectangular in plan view and is comprised of a pair of inflatable pontoons parallel to and on opposite sides of a hull vertical longitudinal center plane with lower extents thereof lying in a hull base plane, inflatable substantially straight forward and rear transverse bridges disposed substantially normal to the center plane with lower extents elevated above the base plane a distance greater than the design draft of the raft, and inflatable substantially straight connecting sections of the hull inclined to the base plane and connecting forward and rear ends of the pontoons to adjacent ends of the respective bridges.

17. A raft according to claim 16 in which the maximum width of the hull is defined by the lengths of the bridges.

18. A raft according to claim 16 in which the bridges extend across the width of the hull.

19. A raft according to claim 18 in which the hull connecting sections extend upwardly and outwardly from the pontoons to the bridges.

20. A raft according to claim 16 including a deck carried between the pontoons.

21. A raft according to claim 20 in which the elevation of the deck above the base plane is greater than the design draft of the raft.

22. A raft according to claim 21 in which elevation of the bridges above the base plane is greater than the elevation of the deck.

23. A raft according to claim 21 in which the length of the deck is less than the distance along the hull between the bridges.

24. A raft according to claim 21 in which the deck has forward and rear edges spaced from the forward and rear bridges.

25. A raft according to claim 16 in which the hull is substantially symmetrical about its midlength.

26. A raft according to claim 16 including a seat for each of a plurality of raft passengers, the seats being located atop the pontoons.

27. A raft according to claim 26 including a stirrup for the foot on the inboard leg of each passenger.

28. A raft according to claim 27 in which the stirrups are located on a deck between the pontoons.

29. A raft according to claim 16 in which the outer side surfaces of the hull between the bridges slope upwardly and outwardly relative to the center plane.

30. An inflatable raft floatable on water having a hull of substantially catamaran configuration comprised of a pair of pontoons parallel to and on opposite sides of a hull vertical longitudinal center plane with lower extents thereof lying in a hull base plane, forward and rear transverse bridges disposed substantially normal to the center plane with lower extents elevated above the base plane a distance greater than the design draft of the raft, and connecting sections of the hull inclined to the base plane and connecting forward and rear ends of the pontoons to the respective bridges, and an inflatable righting structure disposed centrally of the width of the hull and extending between the bridges, the righting structure having a peak intermediate the bridges which is substantially elevated above the hull.

31. A raft according to claim 30 in which the righting structure is of inverted V configuration.

32. A raft according to claim 31 in which the righting structure has substantially straight forward and rear legs connected at the peak and extending to connections to the bridges at ends spaced from the peak.

33. A raft according to claim 30 in which the righting structure, substantially at its peak, includes inflatable sponsons extending a selected distance laterally in opposite directions from the center plane.

34. A raft according to claim 30 in which the distance between opposite ends of the sponsons is a substantial fraction of the width of the hull.

35. An inflatable raft floatable on water comprising a substantially rectangular inflatable hull, the hull being comprised by a pair of spaced parallel pontoons located centrally of the length of the hull with bottom surfaces thereof lying in a hull base plane, forward and rear transverse hull end bridges having lengths normal to a hull vertical longitudinal center plane which are at least equal to the width of the hull, the bridges having lower extents elevated substantially above the base plane, and connecting sections inclined to the base plane connecting the pontoons to the bridges substantially at corners of the raft, the raft further including an inflatable righting arm of substantially inverted V configuration having substantially straight forward and rear legs connected at an arm peak substantially elevated above the pontoons and extending from the peak to connections with the respective bridges.

36. A raft according to claim 35 including a deck carried between the pontoons in spaced relation to the bridges at an elevation above the base plane greater than the design draft of the raft.

* * * * *